US009091186B2

(12) United States Patent
Yamamoto et al.

(10) Patent No.: US 9,091,186 B2
(45) Date of Patent: Jul. 28, 2015

(54) LASH ADJUSTER

(71) Applicant: OTICS CORPORATION, Nishio-shi, Aichi (JP)

(72) Inventors: Hiroki Yamamoto, Hekinan (JP); Yoshiaki Haga, Nishio (JP)

(73) Assignee: OTICS CORPORATION, Nishio-Shi, Aichi (JP)

( * ) Notice: Subject to any disclaimer, the term of this patent is extended or adjusted under 35 U.S.C. 154(b) by 0 days.

(21) Appl. No.: 14/175,653

(22) Filed: Feb. 7, 2014

(65) Prior Publication Data

US 2014/0230767 A1 Aug. 21, 2014

(30) Foreign Application Priority Data

Feb. 15, 2013 (JP) ..... 2013-027982

(51) Int. Cl.
*F01L 1/18* (2006.01)
*F01L 1/24* (2006.01)

(52) U.S. Cl.
CPC . *F01L 1/24* (2013.01); *F01L 1/182* (2013.01); *F01L 1/2405* (2013.01)

(58) Field of Classification Search
CPC ..... F01L 1/182; F01L 1/24; F01L 1/2405
USPC ..... 123/90.46, 90.52, 90.59, 90.43
See application file for complete search history.

(56) References Cited

U.S. PATENT DOCUMENTS 5,509,385 A 4/1996 LaVieri
5,706,773 A 1/1998 Dura et al.
5,979,377 A 11/1999 Barth et al.
2005/0178351 A1 8/2005 Mayer et al.
2014/0224201 A1 8/2014 Oka et al.
2014/0224202 A1 8/2014 Suzuki et al.

(Continued)

FOREIGN PATENT DOCUMENTS

DE 2343269 3/1975
DE 19614668 A1 10/1997
DE 102005025765 12/2006

(Continued)

OTHER PUBLICATIONS

May 15, 2014 generated European Search Report for EP Application No. 14 000 227.0.

(Continued)

*Primary Examiner* — Zelalem Eshete
(74) *Attorney, Agent, or Firm* — Smith, Gambrell & Russell, LLP

(57) ABSTRACT

A lash adjuster includes a plunger and a partitioning member inserted into the plunger. The plunger has a bottom wall with a valve hole and a peripheral wall having an oil passage hole. The plunger defines a high-pressure chamber between the bottom wall and a body. The partitioning member has a baffle having first and second plate surfaces. The baffle has an upper end serving as oil passage end. The plunger has an interior divided into two spaces. The passage hole is located at one space side. An oil passage is defined by an inner peripheral wall surface of the plunger and the first plate surface. A low-pressure chamber is defined at the other space side to store hydraulic fluid. The low-pressure chamber supplies the fluid through the valve hole into the high-pressure chamber and is defined by the inner peripheral wall surface of the plunger and the second plate surface.

11 Claims, 6 Drawing Sheets

(56) References Cited

U.S. PATENT DOCUMENTS

| | | | |
|---|---|---|---|
| 2014/0230766 | A1 | 8/2014 | Fujii et al. |
| 2014/0230768 | A1 | 8/2014 | Haga et al. |

FOREIGN PATENT DOCUMENTS

| | | | |
|---|---|---|---|
| DE | 10 2006 004751 | A1 | 8/2007 |
| DE | 10 2006 007375 | A1 | 8/2007 |
| DE | 10 2006 007376 | | 8/2007 |
| DE | 10 2006 017442 | A1 | 10/2007 |
| EP | 1564383 | | 8/2005 |
| JP | S57 181908 | A | 11/1982 |
| JP | S61 118509 | A | 6/1986 |
| JP | 06-37504 | | 5/1994 |
| JP | 05-288019 | | 11/2003 |
| JP | 2004-197665 | | 7/2004 |
| JP | 2008-064020 | | 3/2008 |
| WO | 92/15776 | A1 | 9/1992 |
| WO | 2007/118820 | A1 | 10/2007 |

OTHER PUBLICATIONS

European Search Report corresponding to co-pending EP application No. 14000213.0 dated Apr. 22, 2014, listed in IDS for U.S. Appl. No. 14/175,560.

European Search Report corresponding to co-pending EP application No. 14000198.3 dated Apr. 14, 2014, listed in IDS for U.S. Appl. No. 14/175,610.

May 2014 generated European Search Report for EP Application No. 14000223, listed in IDS for U.S. Appl. No. 14/175,641.

European Search Report corresponding to co-pending EP application No. 14000199.1 dated Apr. 22, 2014, listed in IDS for U.S. Appl. No. 14/175,670.

LASH ADJUSTER

CROSS-REFERENCE TO RELATED APPLICATIONS

This application is based upon and claims the benefit of priority from the prior Japanese Patent Application No. 2013-27982 filed on Feb. 15, 2013, the entire contents of which are incorporated herein by reference.

BACKGROUND

1. Technical Field

The present invention relates to a lash adjuster.

2. Related Art

A conventional lash adjuster includes a bottomed cylindrical body fixed to a cylinder head of an internal combustion engine and a plunger which is inserted into the body so that the plunger is movable up and down. The plunger has an upper end supporting a rocker arm. The plunger further has a peripheral wall formed with an oil passage hole and a bottom wall formed with a valve hole. Hydraulic fluid, such as oil, supplied through an oil filler hole of the cylinder head is stored in a low-pressure chamber in the plunger through the oil passage hole and also supplied through the valve hole into the body thereby to fill the body. A high-pressure chamber is defined by dividing an interior of the body by the bottom wall of the plunger. The plunger is moved up and down according to oil pressure in the high-pressure chamber. The hydraulic fluid in the low-pressure chamber in the plunger is drawn through the valve hole into the high-pressure chamber when the plunger is moved upward. In this case, there is a possibility that air entrainment may occur in the high-pressure chamber when the hydraulic fluid level is low in the low-pressure chamber.

In view of the aforementioned problem, the conventional art provides a lash adjuster provided with a cylindrical partitioning member inserted into the plunger. A space inside the partitioning member serves as a low-pressure chamber. An oil passage is formed between an inner periphery of the plunger and an outer periphery of the partitioning member. An oil passage end is located above the oil passage hole. As a result, a large amount of hydraulic fluid is supplied from the oil passage hole via the oil passage and the oil passage end into the low-pressure chamber. Since the hydraulic fluid level depends upon the oil passage end located above the oil passage hole, air entrainment can be prevented in the high-pressure chamber.

Furthermore, the partitioning member has a stepped portion formed midway in the up-down direction and is divided into an upper part and a lower part with the stepped portion as a boundary therebetween. The partitioning member further has smaller-diameter portion which is provided in the upper part thereof and has a smaller diameter than the lower part thereof. An oil passage is defined between the smaller-diameter portion and the peripheral wall of the plunger.

The upper part of the partitioning member is squeezed over an entire circumference to serve as the smaller-diameter portion in the above-described conventional lash adjuster. This reduces an inner volume of the low-pressure chamber accordingly. As a result, there is a possibility that a sufficient amount of hydraulic fluid could nor be reserved in the low-pressure chamber.

SUMMARY

Therefore, an object of the invention is to provide a lash adjuster in which the partitioning member is inserted into the plunger and which can increase an amount of hydraulic fluid reserved in the low-pressure chamber.

The invention provides a lash adjuster including a body formed into a bottomed cylindrical shape, a plunger which is inserted into the body so as to be movable up and down, and a partitioning member inserted into the plunger. The plunger has a bottom wall formed with a valve hole and a peripheral wall standing from an outer periphery of the bottom wall and having an oil passage hole formed therethrough, so that the plunger is formed into a bottomed cylindrical shape. The plunger defines a high-pressure chamber between the bottom wall and the body. The partitioning member has a baffle located opposite the oil passage hole in an inserted state thereof into the plunger and comprises a flat plate having a first plate surface and a second plate surface directed in opposite directions. The baffle has an upper end serving as a oil passage end located above the oil passage hole. The plunger has an interior divided into two spaces by the baffle. The oil passage bole is located at one space side. An oil passage is defined at the one space side by an inner peripheral wall surface of the plunger and the first plate surface. A low-pressure chamber is defined, at the other space side to store a hydraulic fluid flowing thereinto through the oil passage hole, the oil passage and the oil passage end. The low-pressure chamber supplies the hydraulic fluid through the valve hole into the high-pressure chamber and is defined by the inner peripheral wall surface of the plunger and the second plate surface.

The interior of the plunger is divided into the two spaces by the plate-like baffle. The low-pressure chamber is defined by the space side opposed to the space side at which the oil passage hole is located. Accordingly, a larger inner volume of the low-pressure chamber can be ensured as compared with the case where the low-pressure chamber is surrounded by the partitioning member over an entire circumference. This can increase an amount of hydraulic fluid stored in the low-pressure chamber.

In one embodiment, the peripheral wall of the plunger is divided into two arcs with the baffle serving as the boundary. The one space side defining the oil passage is a minor arc and the other space side defining the low-pressure chamber is a major arc, whereby the low-pressure chamber has a larger inner volume than the oil passage. This construction can easily ensure a larger inner volume of the low-pressure chamber.

In another embodiment, the baffle is comprised of a flat plate extending in an up-down direction and has a lower end closed by the bottom wall of the plunger when inserted into the plunger. Consequently, the baffle can be prevented from being complicated in construction.

In further another embodiment, the partitioning member has support portions which partially extend outward from both widthwise ends of the baffle and abut on an inner periphery of the peripheral wall of the plunger, thereby retaining the baffle in a standing position. Consequently, the baffle can stably be supported by the support portions in the plunger. Moreover, since the support portions merely partially extend outward from both widthwise ends of the baffle, the inner volume of the low-pressure chamber can be prevented from being reduced as the result of provision of the support portions.

In further another embodiment, each support portion is formed into an arc shape substantially according to the inner periphery of the peripheral wall of the plunger. This can improve retention of each support portion with the result that the partitioning member can be supported further stably by each support portion in the plunger.

In further another embodiment, each support portion is formed into a chordal shape and disposed between two points on the inner periphery of the peripheral wall of the plunger. This simplifies the shape of each support portion with the result that forming or machining of each support portion can be rendered easier. Furthermore, since each support portion has a short length, an occupancy of the support portions in the low-pressure chamber can be rendered small with the result that the inner volume of the low-pressure chamber can be increased accordingly.

DETAILED DESCRIPTION

Figure 1:
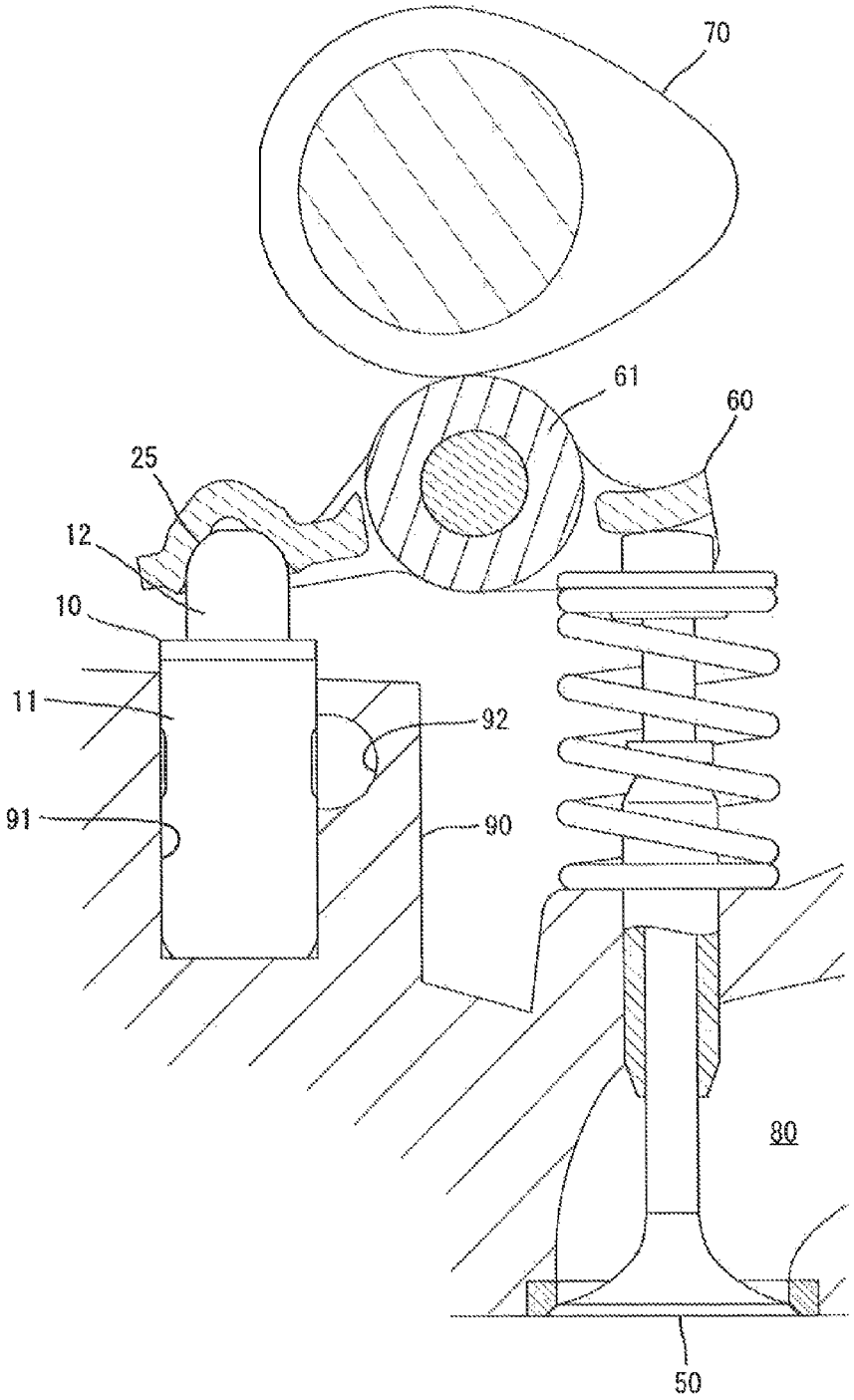
FIG. 1 is a schematic sectional view of an internal combustion engine in which a lash adjuster in accordance with one embodiment is incorporated.

Embodiment 1 of the present invention will be described with reference to FIGS. 1 to 5 of the accompanying drawings. Referring to FIG. 1, a lash adjuster 10 in accordance with embodiment 1 is shown. As shown, the lash adjuster 10 is incorporated in a valve gear of an internal combustion engine. The valve gear includes a valve 50, a rocker arm 60 and a cam 70 in addition, to the lash adjuster 10.

The lash adjuster 10 is inserted into a mounting recess 91 of a cylinder head 90 from above. The valve 50 is provided to be capable of opening and closing an intake/exhaust port 80 of the cylinder head 90. The rocker arm 60 is disposed so as to extend between an upper end (a support portion 25 of a plunger 12 as will be described later) of the lash adjuster 10 and an upper end of the valve 50 in a right-left direction. The cam 70 is disposed above the rocker arm 60 so as to be slidable together with a roller 61 of the rocker arm 60. Upon rotation of the cam 70, the rocker arm 60 is swung in an up-down direction with the upper end of the lash adjuster 10 serving as a fulcrum. With swing of the rocker arm 60, the valve 50 is moved up and down thereby to open and close the intake/exhaust port 80.

Figure 2:
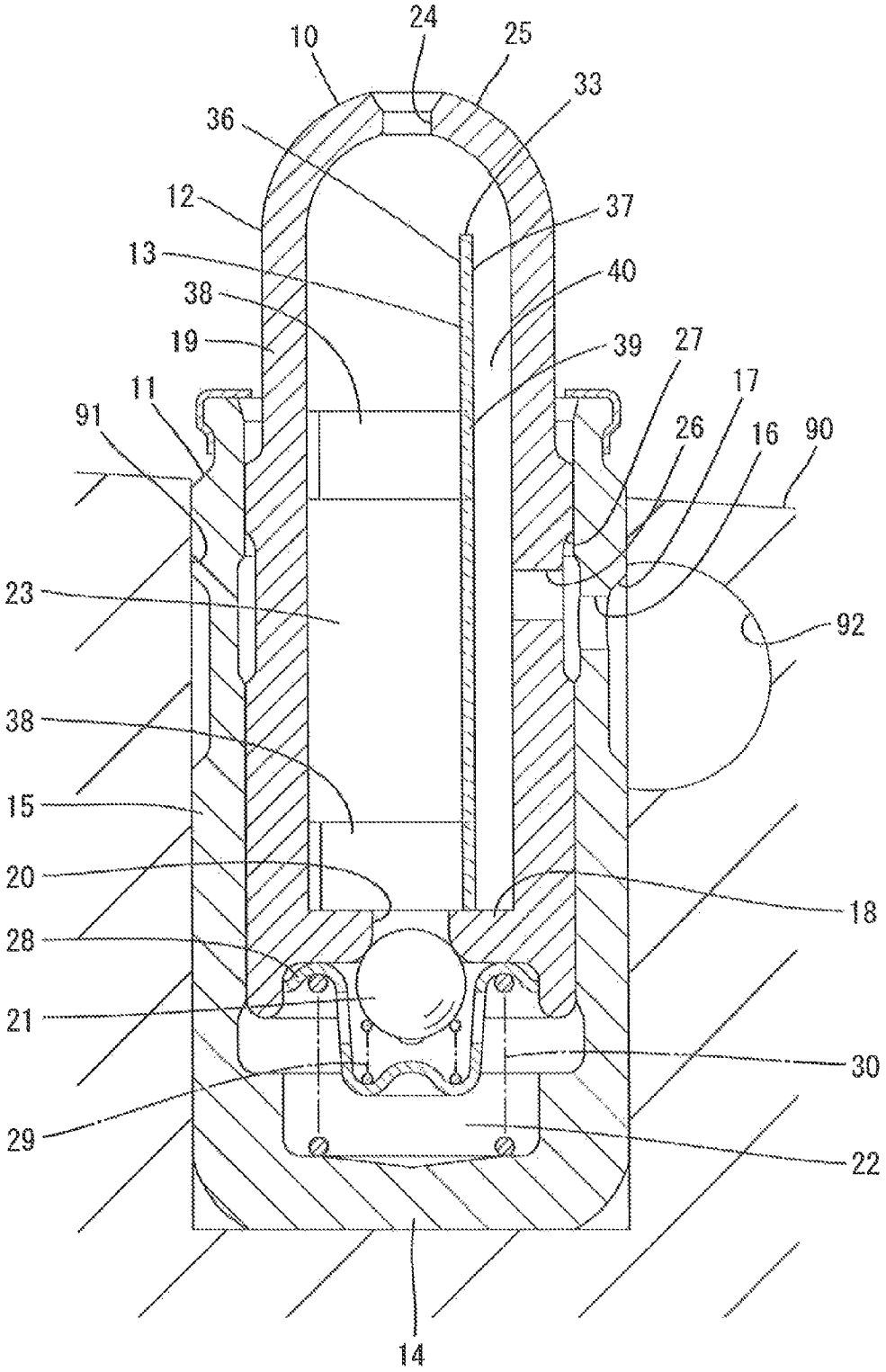
FIG. 2 is a sectional view of the lash adjuster.

The lash adjuster 10 will now be described more concretely. The lash adjuster 10 includes a body 11, a plunger 12 and a partitioning member 13 as shown in FIG. 2. The body 11 has a disc-shaped bottom wall 14 and a cylindrical peripheral wall 15 standing from an outer periphery of the bottom wall 14. The body 11 is formed into a bottomed cylindrical shape as a whole. The body 11 is fittable into the mounting recess 91 of the cylinder head 90. The peripheral wall 15 of the body 11 has an outer oil passage hole 16 formed therethrough. The outer oil passage hole 16 is disposed in communication with an oil filler hole 92 of the cylinder head 90. Furthermore, the body 11 has an outer periphery formed. with an annular recess 17 which extends over the entire periphery thereof and in which the outer oil passage hole 16 is open. Accordingly, the outer oil passage hole 16 and the oil filler hole 92 are retained in communication via the annular recess 17 even when the body 11 is rotated in the mounting recess 91.

The plunger 12 has a disc-shaped bottom wall 18 and a cylindrical peripheral wall 19 standing from an outer periphery of the bottom wall 18 and is formed into a bottomed cylindrical shape as a whole. The bottom wall 18 includes a central part through which a valve hole 20 is formed. The valve hole 20 communicates between a high-pressure chamber 22 and a low-pressure chamber 23 via a valve element 21 as will be described later. The peripheral wall 19 has an upper end formed with a semispherical support portion 25 which is radially squeezed and has a centrally located through hole 24. The support portion 25 includes an outer semispherical surface on which a rocker arm 60 is adapted to slide during swinging.

The peripheral wall 19 is also formed with an oil passage hole 26. The peripheral wall 19 has an outer periphery formed with an annular recess 27 which extends over the whole periphery thereof and in which the oil passage hole 26 is open. The oil passage hole 26 communicates with the outer oil passage hole 16 of the body 11 via the annular recess 27, and the of passage hole 26 and the outer oil passage bole 16 are retained in communication even when the plunger 12 is rotated in the body 11.

The high-pressure chamber 22 is defined between the bottom wall 18 of the plunger 12 and the body 11 when the plunger 12 is inserted into the body 11, as shown in FIG. 2. A spherical valve element 21 is provided in the high-pressure chamber 22. The valve element 21 is housed in a cage-like retainer 28 and biased by a first spring 29 in a direction such that the valve hole 20 is closed. The high-pressure chamber 22 is also provided with a second spring 30 located between the bottom wall 14 of the body 11 and an upper edge of the retainer 28. The plunger 12 is biased upward by the second spring 30.

Figure 3:
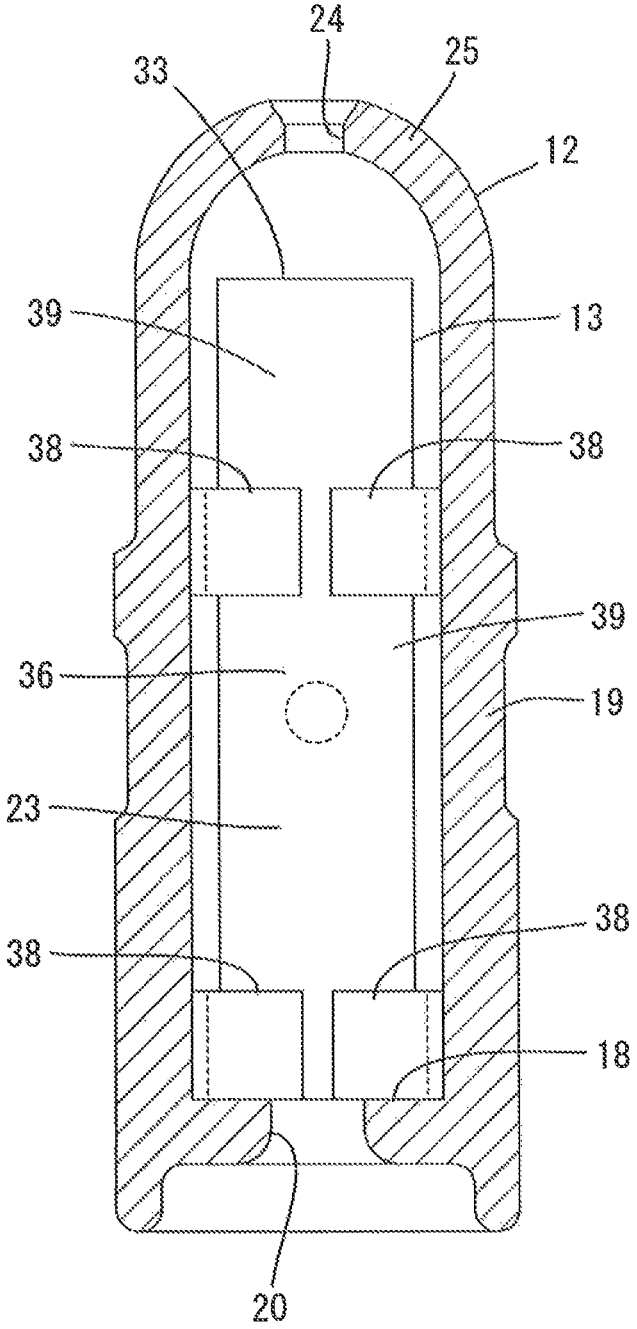
FIG. 3 is a sectional view of the plunger in which the partitioning member is inserted.
Figure 4:
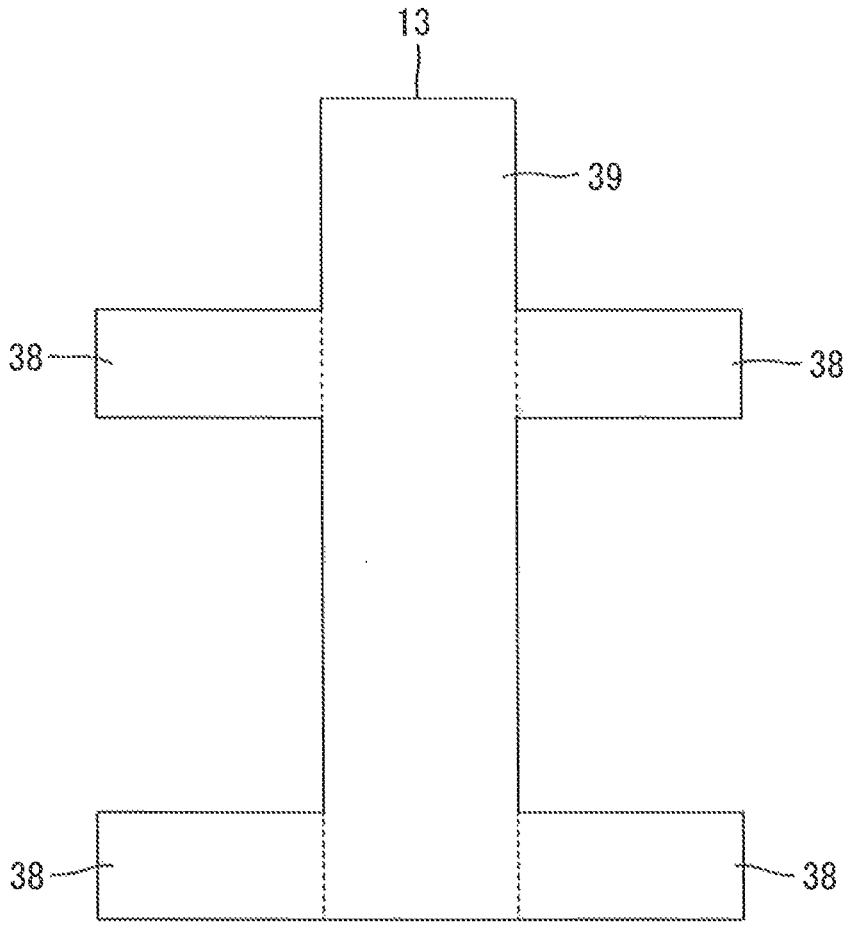
FIG. 4 is a development view of the partitioning member.

The partitioning member 13 is inserted into the plunger 12. The partitioning member 13 is formed of a metallic flat plate and includes a rectangular elongated baffle 39 extending in the up-down direction and a plurality of support portions 38 protruding widthwise outward from both widthwise ends of the baffle 39 respectively, as shown in FIGS. 3 and 4.

Figure 5:
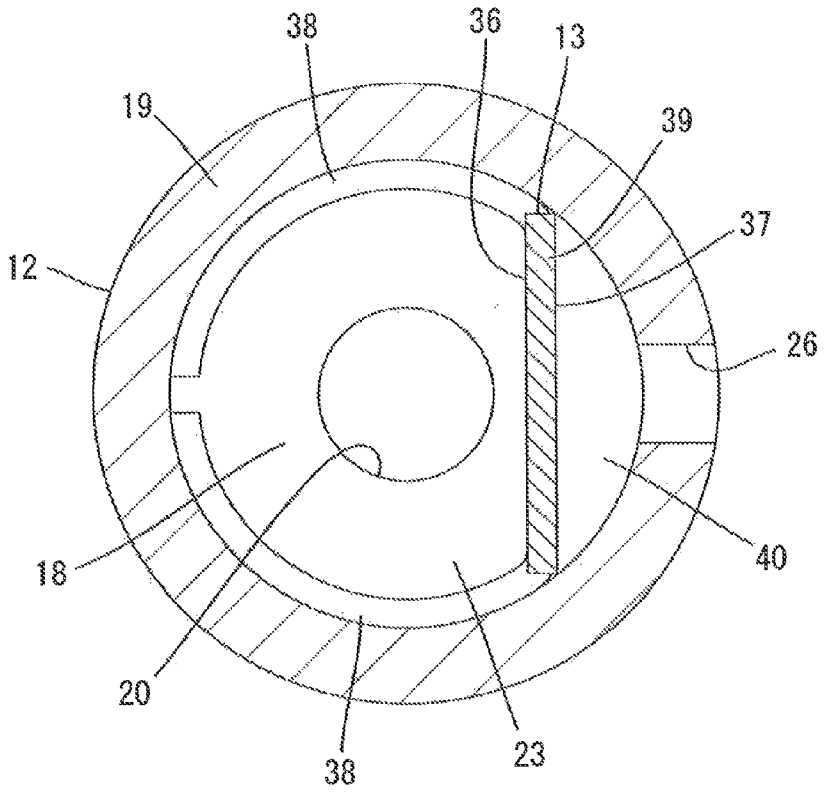
FIG. 5 is a transverse sectional view of the plunger with the partitioning member inserted therein, so that the interior of the plunger is divided into two spaces.

The baffle 39 has a width smaller than an inner diameter of the plunger 12 and extends with a uniform width in the up-down direction. As shown in FIGS. 2 and 5, in a state where the partitioning member 13 is inserted into the plunger 12, a first plate surface 37 of the baffle 39 is located opposite the oil passage hole 26 and the baffle 39 is disposed along the up-down direction while both widthwise ends of the baffle 39 abut on the inner periphery of the peripheral wall 19 of the plunger 12, and furthermore, the baffle 39 has a lower end disposed along a direction of a chord while in abutment with an upper surface of the bottom wall 18 of the plunger 12. In embodiment 1, the first plate surface 37 of the baffle 39 is adapted to be disposed along a direction substantially perpendicular to the direction in which the oil passage hole 26 extends through the peripheral wall 19.

As shown in FIG. 5, the peripheral wall 19 of the plunger 12 is divided into two arcs with the baffle 39 serving as the boundary, and one arc where the oil passage hole 26 is located is a minor arc and the other arc where the oil passage hole 26 is not located is a major arc. In the state where the partitioning member 13 is inserted in the plunger 12, an oil passage 40 is defined between an inner peripheral surface of the peripheral wall 19 located at the minor chord side and the first plate surface 37 of the baffle 39. The oil passage 40 has a generally semicircular cross-section and is elongated in the up-down direction as shown in FIG. 2. The oil passage 40 has a lower end closed by the bottom wall 18 of the plunger 12 and an upper open end facing the upper end of the baffle 39. The upper end of the baffle 39 is formed as an oil passage end 33 and disposed near the support portion 25 of the plunger 12 above the oil passage hole 26.

A low-pressure chamber 23 is defined between an inner peripheral surface of the peripheral wall 19 located at the major chord side and a second plate surface 36 (a surface located opposite side of the first plate surface 37), as shown in FIG. 5. The low-pressure chamber 23 has a generally truncated circular cross-section and extends in the up-down direction, as shown in FIG. 2. The low-pressure chamber 23 has a lower end which faces the bottom wall 18 of the plunger 12 to communicate with the valve hole 20 and an upper end defined by the upper end of the baffle 39. The low-pressure chamber 23 thus constructed has a sufficiently larger inner capacity than the oil passage 40.

As shown in FIG. 4, the lower support portions 38 are connected integrally to both lower widthwise ends of the baffle 39, and the other support portions 38 are connected integrally to parts of both widthwise ends of the baffle 39 located midway in the up-down direction, respectively. Each support portion 38 is rectangular and elongated in a direction perpendicular to the direction in which the baffle 39 extends. In the state where the partitioning member 13 is inserted in the plunger 12, each support portion 38 takes a form of an arc shape so as to be abuttable along the inner peripheral surface of the plunger 12, as shown in FIG. 5. In this case, the lower support portions 38 are disposed to be abuttable along the upper surface of the bottom wall 18 of the plunger 12. The baffle 39 is adapted to be retained in the plunger 12 while being kept in an upright position by the support portions 38.

In embodiment 1, the partitioning member 13 is inserted into the plunger 12 through an upper open end of the plunger 12 which has not been formed with the support portion 25. In this case, the partitioning member 13 is press-fitted into the plunger 12 and shrinkage-fitted in some cases. The upper end of the plunger 12, is squeezed in a diameter-reducing direction in the state where the partitioning member 13 is inserted in the plunger 12, so that the support portion 25 is formed together with a through hole 24.

The hydraulic fluid flowing through the oil filler hole 92 of the cylinder head 90 is supplied sequentially through the outer oil passage hole 16, the oil passage hole 26, the oil passage 40 and the oil passage end 33 to be reserved in the low-pressure chamber 23. The hydraulic fluid reserved in the low-pressure chamber 23 is further supplied through the valve hole 20 to fill the high-pressure chamber 22. In this case, since the oil passage end 33 of the partitioning member 13 is located above the oil passage hole 26, the hydraulic fluid is reserved in the low-pressure chamber 23 to a level above the oil passage hole 26.

The valve element 21 closes the valve hole 20 thereby to close the high-pressure chamber 22 when a downward pressure is applied from the rocker arm 60 side to the plunger 12 in the state where the hydraulic fluid has been introduced into the low-pressure chamber 23 and the high-pressure chamber 22. As a result, the plunger 12 is stopped lowering by the hydraulic pressure of the high-pressure chamber 22. On the other hand, when the plunger 12 is raised with decrease in the pressure from the rocker arm 60 side, the capacity of the high-pressure chamber 22 is increased. When the capacity of the high-pressure chamber 22 is increased, the valve element 21 is lowered thereby to open the valve hole 20. As a result, the hydraulic fluid in the low-pressure chamber 23 flows through the valve hole 20 into the high-pressure chamber 22 thereby to fill the high-pressure chamber 22. Upon stop of the upward movement of the plunger 12, the valve element 21 is biased by the first spring 29 thereby to be moved upward and close the valve hole 20, so that the high-pressure chamber 22 is closed. Thus, the plunger 12 is moved up and down relative to the body 11, whereby the support position of the plunger 12 relative to the rocker arm 60 fluctuates with the result that a valve clearance is adjusted.

According to embodiment 1, as described above, the interior of the plunger 12 is divided by the plate-shaped baffle 39 into two spaces. At the side where the oil passage hole 26 is located, the oil passage 40 is defined between the inner peripheral surface of the peripheral wall 19 located at the minor chord side and the first plate surface 37 of the baffle 39. At the side opposed to the side of the oil passage hole 26, the low-pressure chamber 23 is defined between the major chord side inner peripheral surface of the peripheral wall 19 and the second plate surface 36 of the baffle 39. This can ensure a larger inner capacity of the low-pressure chamber 23 as compared with the case where the low-pressure chamber 23 and the oil passage 40 are formed inside and outside the cylindrical partitioning member 13 inserted into the plunger 12, with the result that an amount of the hydraulic fluid reserved in the low-pressure chamber 23 can be increased.

Furthermore, the baffle 39 is stably held the plunger 12 by the support portions 38. In this case, since the support portions 38 merely partially extend from the vertical portions of both widthwise ends of the baffle 19, the inner capacity of the low-pressure chamber 23 is not reduced especially. Furthermore, since each support portion 38 is formed into the arc shape substantially extending along the inner periphery of the peripheral wall 19 of the plunger 12, the holding force of each support portion 38 can be improved with the result that the partitioning member 13 can be supported further stably by the support portions 38 in the plunger 12.

Figure 6:
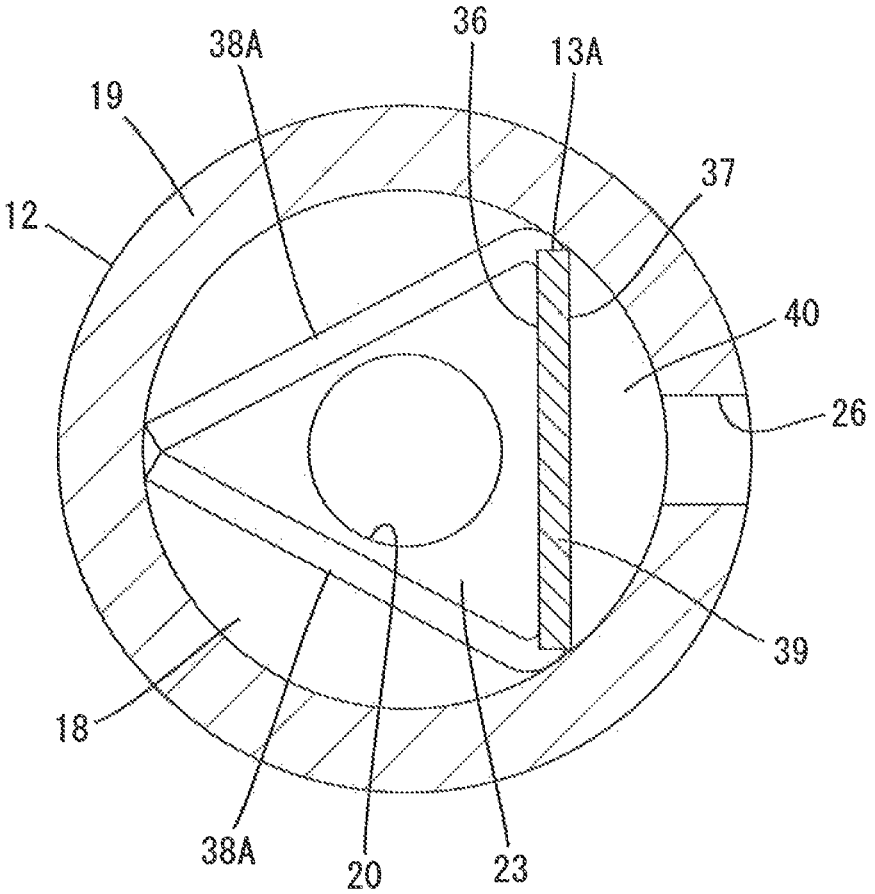
FIG. 6 is a view similar to FIG. 5, showing the lash adjuster in accordance with embodiment 2.

FIG. 6 illustrates embodiment 2. Embodiment 2 differs from embodiment 1 in the shape of the support portions 38A of the partitioning member 13A. Accordingly, identical or similar parts in embodiment 2 are labeled by the same reference symbols as those in embodiment 1 and description of these parts will be eliminated. Only the difference will be described in the following.

The partitioning member 13A has the same developed configuration as the partitioning member 13 in embodiment 1 (see FIG. 4). The partitioning member 13A has a plurality of support portions 38A protruding outward from the baffle 39. More specifically, the support portions 33A include lower support portions 38A connected integrally to both lower widthwise ends of the baffle 39 and the otter support portions 38A are connected integrally to parts of both widthwise ends of the baffle 39 located midway in the up-down direction, respectively. Each support portion 38A has a shape differing from the shape in embodiment 1 in the state where the partitioning member 13A is inserted in the plunger 12. More specifically, as shown in FIG. 6, the support portions 38A extend linearly from both widthwise ends of the baffle 39 while intersecting at a sharp angle with the first and second plate surfaces 37 and 36 in the state where the partitioning member 13A is inserted in the plunger 12, so that the extending ends of the support portions 38A are abuttable with each other at a location opposed to a widthwise central part of the baffle 39. In this case, the support portions 38A present a triangular section in conjunction with the baffle 39, being disposed in the form of a chord between two points on the inner periphery of the plunger 12. As a result, the partitioning member 13A is held on the inner periphery of the peripheral wall 19 of the plunger 12 in a three-point support manner.

According to embodiment 2, the machining can be rendered easier since the shape of each support portion 38A is simplified. Furthermore, since the extending length of each support portion 38A is shorter, an area occupied by the support portions 38A in the low-pressure chamber 23 can be reduced and the inner capacity of the low-pressure chamber 23 can be increased accordingly.

The invention should not be limited to the foregoing embodiments 1 and 2 and the following embodiments are included in the technical scope of the invention.

(1) The oil passage end may be formed into the shape of a cutout in the upper end of the partitioning member.

(2) The first and second plate surfaces may be formed into curved shapes. In this case, the baffle desirably has an arc-shaped section.

(3) The plunger may include an upper part and a lower part both of which are separate from each other and are coupled integrally with each other.

(4) The number and locations of the support portions are optional and should not be limited to the number and locations in embodiment 1.

What is claimed is:

1. A lash adjuster comprising:

a body formed into a bottomed cylindrical shape;

a plunger which is inserted into the body so as to be movable up and down and has a bottom wall formed with a valve hole and a peripheral wall standing from an outer periphery of the bottom wall and having an oil passage hole formed therethrough, so that the plunger is formed into a bottomed cylindrical shape, the plunger defining a high-pressure chamber between the bottom wall and the body; and a partitioning member inserted into the plunger, wherein:

the partitioning member has a baffle located opposite the oil passage hole in an inserted state thereof into the plunger and comprising a flat plate having a first plate surface and a second plate surface directed in opposite directions, the baffle having an upper end serving as an oil passage end located above the oil passage hole;

the plunger has an interior divided into two spaces by the baffle, the oil passage hole being located at one space side;

an oil passage is defined at said one space side by an inner peripheral wall surface of the plunger and the first plate surface; and a low-pressure chamber is defined at the other space side to store a hydraulic fluid flowing thereinto through the oil passage hole, the oil passage and the oil passage end, the low-pressure chamber supplying the hydraulic fluid through the valve hole into the high-pressure chamber and being defined by the inner peripheral wall surface of the plunger and the second plate surface.

2. The lash adjuster according to claim 1, wherein the peripheral wall of the plunger is divided into two arcs with the baffle serving as a boundary, and said one space side defining the oil passage is a minor arc and said other space side defining the low-pressure chamber is a major arc, whereby the low-pressure chamber has a larger inner volume than the oil passage.

3. The lash adjuster according to claim 1, wherein the baffle is comprised of a flat plate extending in an up-down direction and has a lower end closed by the bottom wall of the plunger in a state where the baffle is inserted in the plunger.

4. The lash adjuster according to claim 1, wherein the partitioning member has support portions which partially extend outward from both widthwise ends of the baffle respectively and abut on an inner periphery of the peripheral wall of the plunger, thereby retaining the baffle in a standing position.

5. The lash adjuster according to claim 4, wherein each support portion is formed into an arc shape substantially according to the inner periphery of the peripheral wall of the plunger.

6. The lash adjuster according to claim 4, wherein each support portion is formed into a chordal shape and disposed between two parts on the inner periphery of the peripheral wall of the plunger.

7. A lash adjuster comprising:

a body formed into a bottomed cylindrical shape;

a plunger which is inserted into the body so as to be movable up and down and has a bottom wall formed with a valve hole and a peripheral wall standing from an outer periphery of the bottom wall and having an oil passage hole formed therethrough, so that the plunger is formed into a bottomed cylindrical shape, the plunger defining a high-pressure chamber between the bottom wall and the body; and a partitioning member inserted into the plunger, wherein:

the partitioning member has a baffle plate located opposite the oil passage hole in an inserted state thereof into the plunger, the baffle plate having an upper end serving as an oil passage end located above the oil passage hole;

the plunger has an interior divided into two spaces by the baffle plate, the oil passage hole being located at one space side;

an oil passage is defined at said one space side;

a low-pressure chamber is defined at the other space side to store a hydraulic fluid flowing thereinto through the oil passage hole, the oil passage and the oil passage end, the low-pressure chamber supplying the hydraulic fluid through the valve hole into the high-pressure chamber, and wherein the partitioning member has support portions which partially extend outward from both widthwise ends of the baffle plate respectively and abut on an inner periphery of the peripheral wall of the plunger, thereby retaining the baffle plate in a standing position.

8. The lash adjuster according to claim 7, wherein each support portion is formed into an arc shape substantially according to the inner periphery of the peripheral wall of the plunger.

9. The lash adjuster according to claim 7, wherein each support portion is formed into a chordal shape and disposed between two parts on the inner periphery of the peripheral wall of the plunger.

10. The lash adjuster according to claim 7, wherein the peripheral wall of the plunger is divided into two arcs with the baffle plate serving as a boundary, and said one space side defining the oil passage is a minor arc and said other space side defining the low-pressure chamber is a major arc, whereby the low-pressure chamber has a larger inner volume than the oil passage.

11. The lash adjuster according to claim 7, wherein the baffle plate is comprised of a flat plate extending in an up-down direction and has a lower end closed by the bottom wall of the plunger in a state where the baffle plate is inserted in the plunger.

* * * * *